US010209669B2

(12) United States Patent
Makita et al.

(10) Patent No.: US 10,209,669 B2
(45) Date of Patent: Feb. 19, 2019

(54) DEVELOPER CARRIER, DEVELOPING DEVICE, AND IMAGE FORMING APPARATUS

(71) Applicant: FUJI XEROX CO., LTD., Tokyo (JP)

(72) Inventors: Shota Makita, Kanagawa (JP); Shinichi Ohba, Kanagawa (JP); Iori Togu, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/697,697

(22) Filed: Sep. 7, 2017

(65) Prior Publication Data

US 2018/0259901 A1 Sep. 13, 2018

(30) Foreign Application Priority Data

Mar. 9, 2017 (JP) ..... 2017-045379

(51) Int. Cl.
*G03G 21/18* (2006.01)
*G03G 15/08* (2006.01)
*G03G 21/16* (2006.01)

(52) U.S. Cl.
CPC ..... *G03G 21/1857* (2013.01); *G03G 15/0879* (2013.01); *G03G 15/0889* (2013.01); *G03G 15/0865* (2013.01); *G03G 21/1647* (2013.01); *G03G 2221/1657* (2013.01)

(58) Field of Classification Search
None
See application file for complete search history.

(56) References Cited

U.S. PATENT DOCUMENTS 5,675,893 A * 10/1997 Yamada ..... B21D 39/04 29/895.2
5,903,803 A * 5/1999 Kawai ..... F16D 1/101 399/111
2001/0024581 A1* 9/2001 Miyabe ..... G03G 15/0935 399/119

FOREIGN PATENT DOCUMENTS

JP 02-165181 A 6/1990
JP 2004-361719 A 12/2004

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A developer carrier includes a transmitting member that is rotatable and transmits a driving force; and a developer carrying member that carries developer and is provided coaxially with the transmitting member, the developer carrying member being rotatable when receiving the driving force from the transmitting member, the developer carrying member being displaceable with respect to the transmitting member in an intersecting direction that intersects an axial direction of the transmitting member.

12 Claims, 8 Drawing Sheets

DEVELOPER CARRIER, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2017-045379 filed Mar. 9, 2017.

BACKGROUND

Technical Field

The present invention relates to a developer carrier, a developing device, and an image forming apparatus.

SUMMARY

According to an aspect of the invention, there is provided a developer carrier including a transmitting member that is rotatable and transmits a driving force; and a developer carrying member that carries developer and is provided coaxially with the transmitting member, the developer carrying member being rotatable when receiving the driving force from the transmitting member, the developer carrying member being displaceable with respect to the transmitting member in an intersecting direction that intersects an axial direction of the transmitting member.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
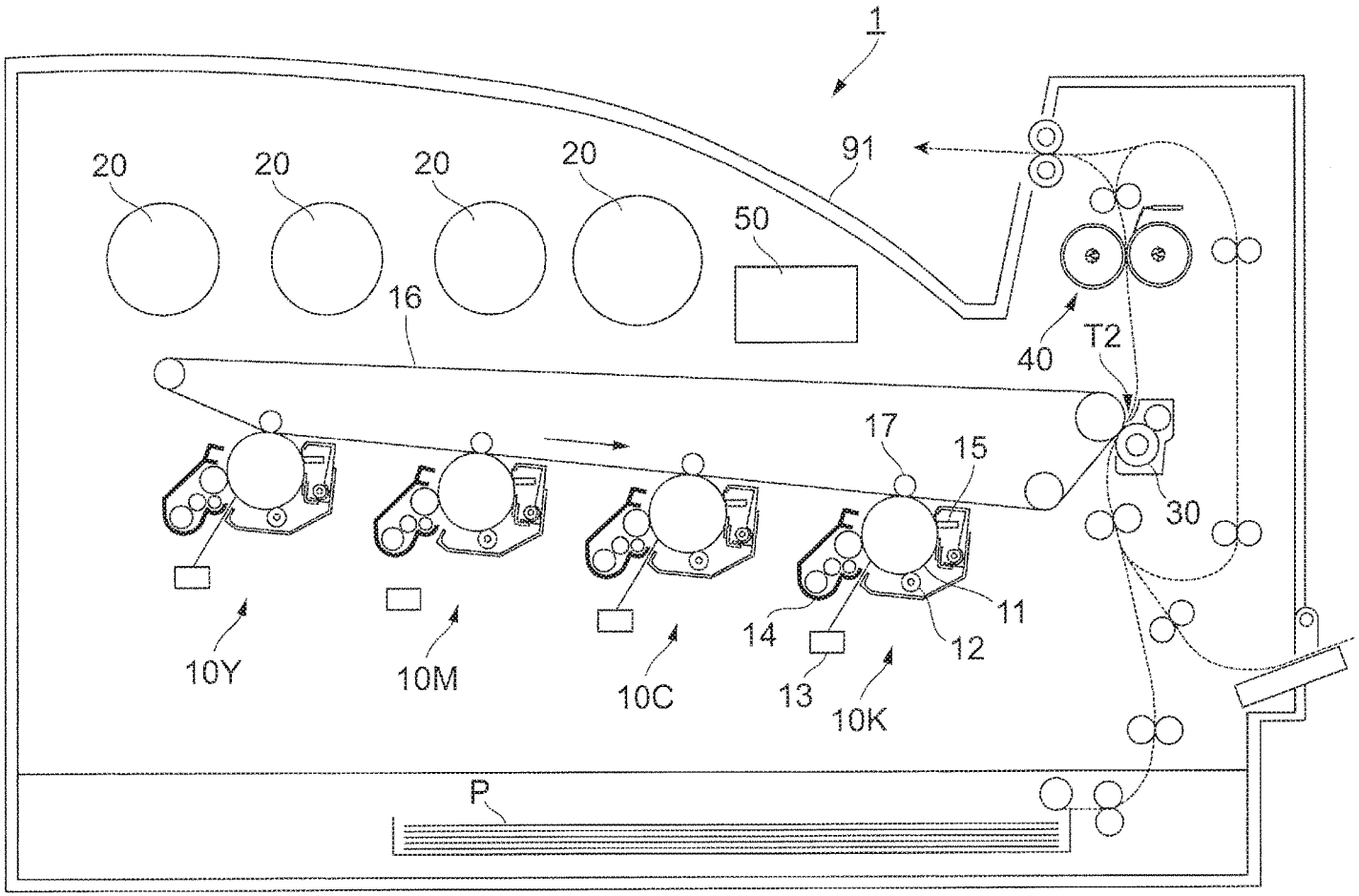
FIG. 1 illustrates an exemplary configuration of an image forming apparatus to which a first exemplary embodiment is applied.

FIG. 1 is a schematic diagram of an image forming apparatus 1 according to a first exemplary embodiment.

The image forming apparatus 1 includes plural image forming units 10 (10Y, 10M, 10C, and 10K) provided for yellow (Y), magenta (M), cyan (C), and black (K). The image forming unit 10 are exemplary image forming devices.

The image forming units 10 each include a photoconductor drum 11, a charging roller 12 that charges the photoconductor drum 11, and an exposure unit 13. The exposure unit 13 applies light to the surface of the photoconductor drum 11 that has been charged by the charging roller 12, thereby forming an electrostatic latent image thereon.

The image forming unit 10 further includes a developing unit 14 as an exemplary developing device. The developing unit 14 develops the electrostatic latent image formed on the photoconductor drum 11 by the exposure unit 13 into a toner image. The image forming unit 10 further includes a cleaning device 15 that removes waste toner from the photoconductor drum 11.

The image forming apparatus 1 further includes an intermediate transfer belt 16 to which the toner images in the respective colors formed on the photoconductor drums 11 of the respective image forming units 10 are transferred in such a manner as to be superposed one on top of another. The image forming apparatus 1 further includes first transfer rollers 17 with which the toner images in the respective colors formed by the image forming units 10 are sequentially transferred to the intermediate transfer belt 16 (first transfer).

The image forming apparatus 1 further includes a second transfer roller 30 with which the toner images superposed on the intermediate transfer belt 16 are collectively transferred to a sheet P as an exemplary recording medium (second transfer).

The image forming apparatus 1 further includes a fixing unit 40 that fixes the toner images transferred to the sheet P in the second transfer.

The image forming apparatus 1 further includes toner cartridges 20 that contain toners to be supplied to the respective developing units 14 of the image forming units 10. The image forming apparatus 1 further includes a controller 50 that controls the entirety of the image forming apparatus 1.

The image forming apparatus 1 executes a series of image forming operations under the control of the controller 50.

Specifically, image data acquired by an apparatus such as a personal computer (PC) or a scanner is first processed by an image processing unit (not illustrated), whereby pieces of image data for the respective colors are generated. The pieces of image data for the respective colors are transmitted to the respective exposure units 13.

In the image forming units 10, the exposure units 13 apply light to the photoconductor drum 11, and the developing units 14 perform development, whereby toner images are formed on the photoconductor drums 11.

The toner images thus formed on the photoconductor drums 11 of the image forming units 10 are electrostatically transferred sequentially to the intermediate transfer belt 16 (the first transfer) by the respective first transfer rollers 17. Thus, a set of toner images for the respective colors that are superposed one on top of another are formed on the intermediate transfer belt 16.

With the rotation of the intermediate transfer belt 16, the set of toner images on the intermediate transfer belt 16 is transported to a second transfer area T2, where the second transfer roller 30 is provided.

Meanwhile, in the image forming apparatus 1 according to the first exemplary embodiment, a sheet P is transported to the second transfer area T2 synchronously with the transport of the set of toner images.

The set of toner images on the intermediate transfer belt 16 is electrostatically transferred to the thus transported sheet P (second transfer) in the second transfer area T2 with a transfer electric field generated by the second transfer roller 30.

The sheet P now having the set of toner images electrostatically transferred thereto is transported to the fixing unit 40 and is fixed by the fixing unit 40. The sheet P having undergone the fixing is transported to a sheet stacking portion 91 provided at the top of the image forming apparatus 1.

Figure 2:
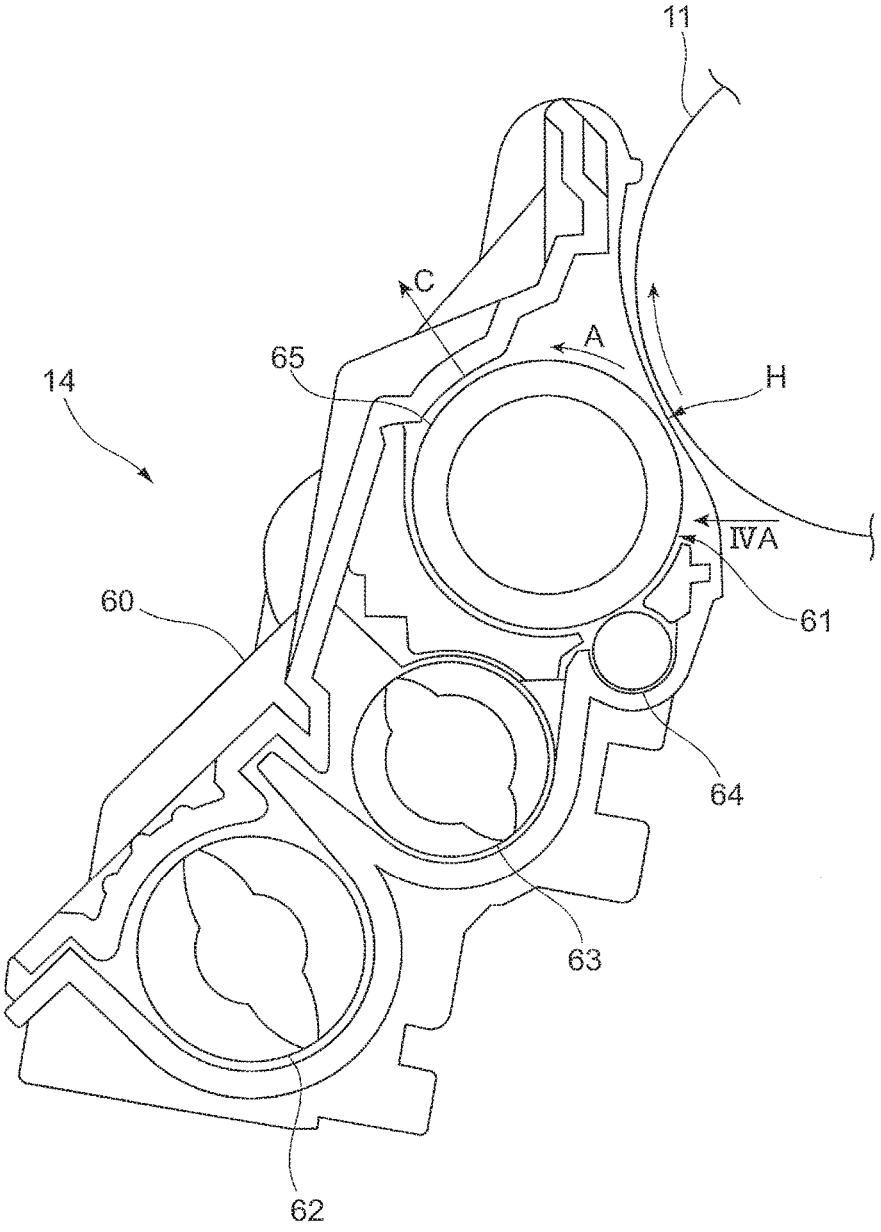
FIG. 2 illustrates a configuration of a developing unit.

FIG. 2 illustrates a configuration of the developing unit 14.

The developing unit 14 includes a developing housing 60. The developing housing 60 contains a two-component developer (not illustrated) containing negatively charged toner particles and positively charged carrier particles. The developing housing 60 has an open portion H (an opening for development) that faces the photoconductor drum 11.

While the first exemplary embodiment concerns a case where a two-component developer is employed, one-component developer that contains toner particles but no carrier particles may alternatively be employed.

The developing unit 14 includes a developing roller 61 as an exemplary developer carrier. The developing roller 61 is provided at the open portion H of the developing housing 60.

The developing roller 61 is positioned in such a manner as to face the photoconductor drum 11 and is rotatable in the counterclockwise direction in FIG. 2. The developing roller 61 has a function of attaching toner particles of the developer to the surface of the photoconductor drum 11 and thus developing the electrostatic latent image on the photoconductor drum 11. Therefore, the developing roller 61 is regarded as a developer attaching device.

The developing unit 14 further includes a pair of developer transporting members 62 and 63 as other exemplary developer attaching devices that transport the developer to the developing roller 61 and attach the developer to the developing roller 61.

The pair of developer transporting members 62 and 63 are provided below the developing roller 61 and each extend in the axial direction of the photoconductor drum 11. The developer transporting members 62 and 63 are rotatable.

The developer transporting members 62 and 63 each include a rotating shaft and a helical projection provided around the rotating shaft. When the developer transporting members 62 and 63 rotate, the respective helical projections each transport the developer in the axial direction of the developer transporting member 62 or 63.

Hereinafter, the developer transporting member 62 that is farther from the developing roller 61 is referred to as the first developer transporting member 62, and the developer transporting member 63 that is nearer to the developing roller 61 is referred to as the second developer transporting member 63.

The developing unit 14 further includes a trimmer 64. The trimmer 64 is provided below the developing roller 61 and at a predetermined distance from the developing roller 61.

The trimmer 64 restricts the movement of the developer on the developing roller 61, thereby setting the thickness of a developer layer formed on the developing roller 61 to a predetermined thickness.

The developing housing 60 has a supply port (not illustrated) that receives a fresh portion of the developer supplied from the toner cartridge 20, and a discharge port (not illustrated) from which an excessive portion of the developer is discharged.

The developing roller 61 rotates in the direction of arrow A illustrated in FIG. 2. Specifically, the developing roller 61 rotates in the counterclockwise direction in FIG. 2, or in the same direction as the direction of rotation of the photoconductor drum 11 at the development position that faces the photoconductor drum 11.

The developing roller 61 receives, at a part thereof facing the second developer transporting member 63, the developer (toner particles) supplied from the second developer transporting member 63 and then transports the developer to the position facing the photoconductor drum 11. At that position, the developing roller 61 attaches the developer to the surface of the photoconductor drum 11.

The second developer transporting member 63 transports the developer in the developing housing 60 toward one side in the axial direction of the second developer transporting member 63. The first developer transporting member 62 transports the developer in the developing housing 60 toward the other side opposite the one side.

In the first exemplary embodiment, the developer in the developing housing 60 is transported (circulated) by the first developer transporting member 62 and the second developer transporting member 63 as described above and is stirred while being transported.

Figure 3:
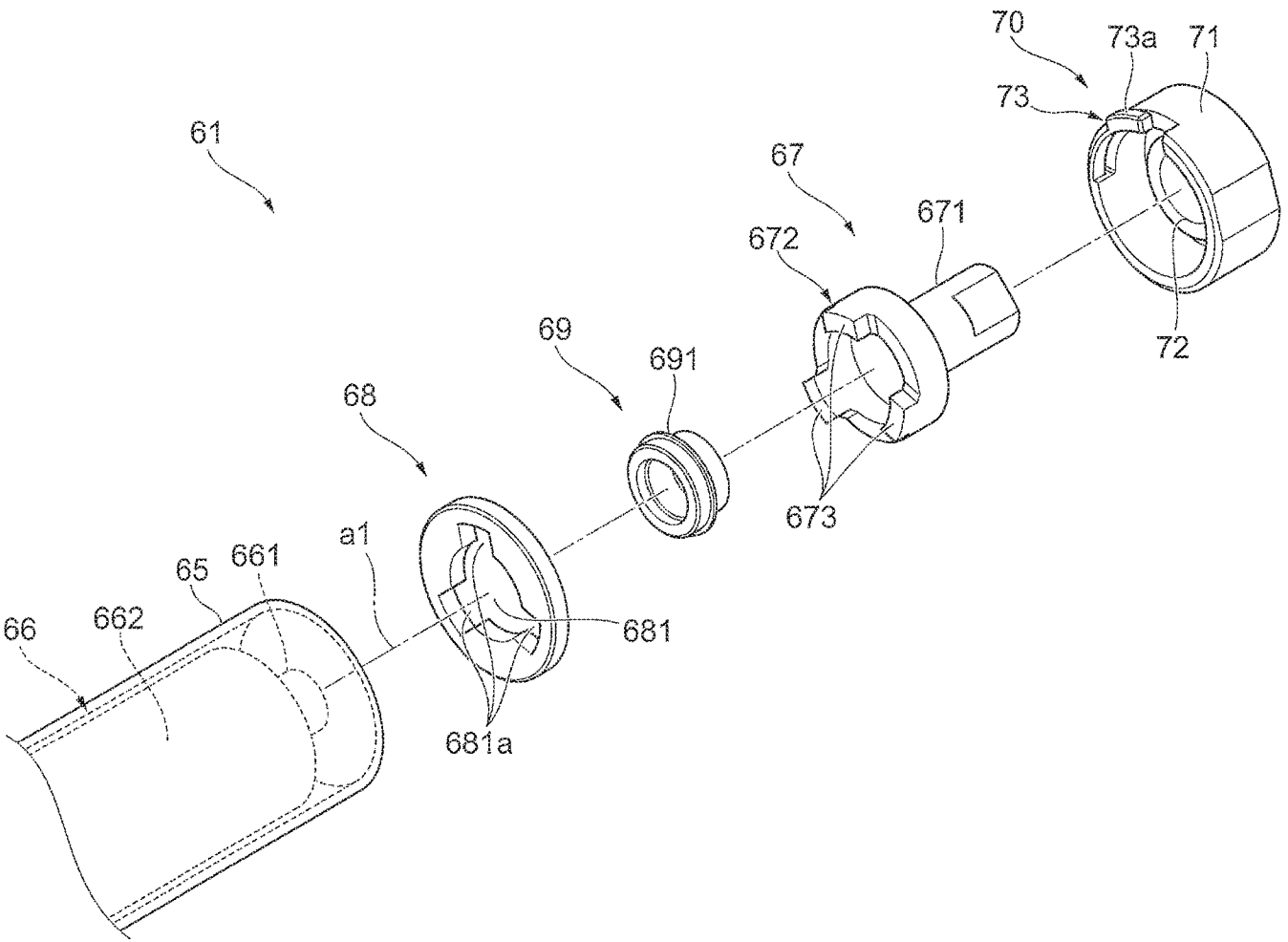
FIG. 3 illustrates a developing roller.

FIG. 3 illustrates the developing roller 61.

Figure 4A:
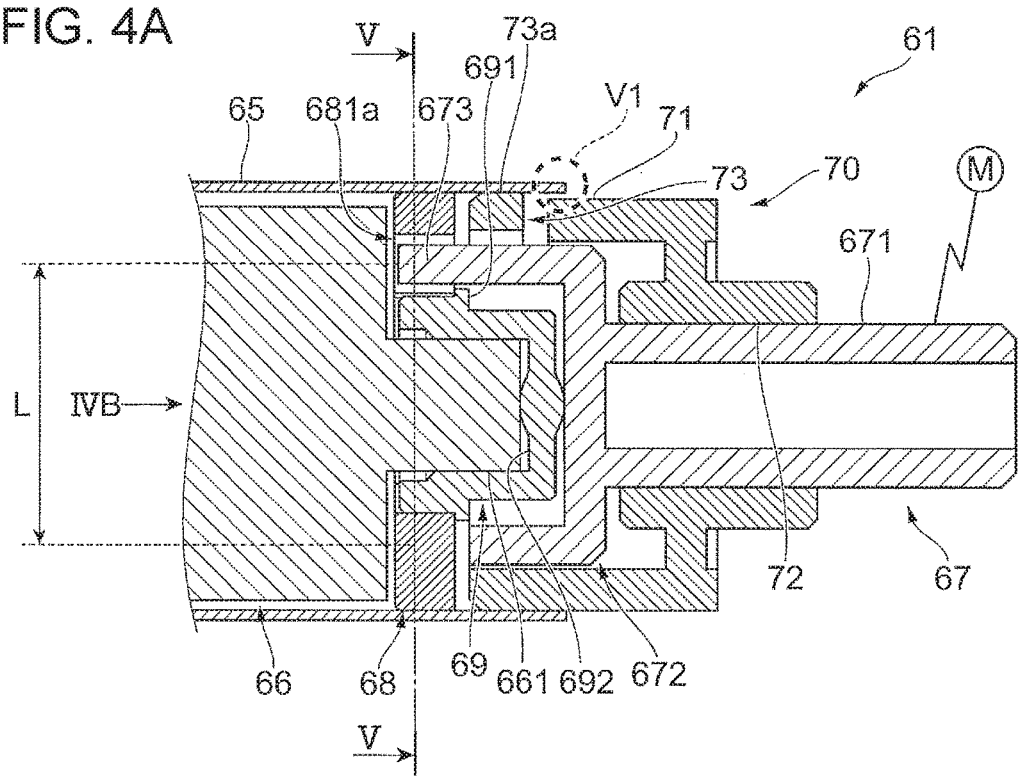
FIG. 4A illustrates a configuration of one axial end of the developing roller.

FIG. 4A illustrates a configuration of one axial end of the developing roller 61 (an end of the developing roller 61 on the far side in the depth direction in FIG. 2). More specifically, FIG. 4A is a sectional view of the developing roller 61 seen in the direction of arrow IVA illustrated in FIG. 2 and illustrates a part thereof that is at the far-side end in the depth direction in FIG. 2.

Figure 4B:
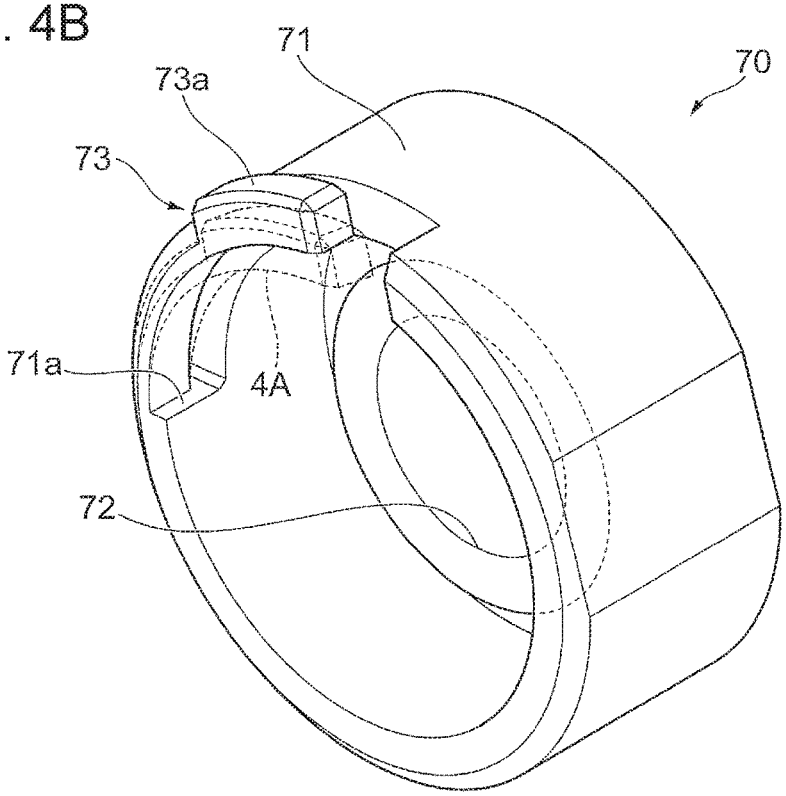
FIG. 4B is a perspective view of a supporting member included in the developing roller.

FIG. 4B is a perspective view of a supporting member 70 (see FIG. 4A) included in the developing roller 61. More specifically, FIG. 4B is a perspective view of the supporting member 70 seen in the direction of arrow IVB illustrated in FIG. 4A.

Figure 5:
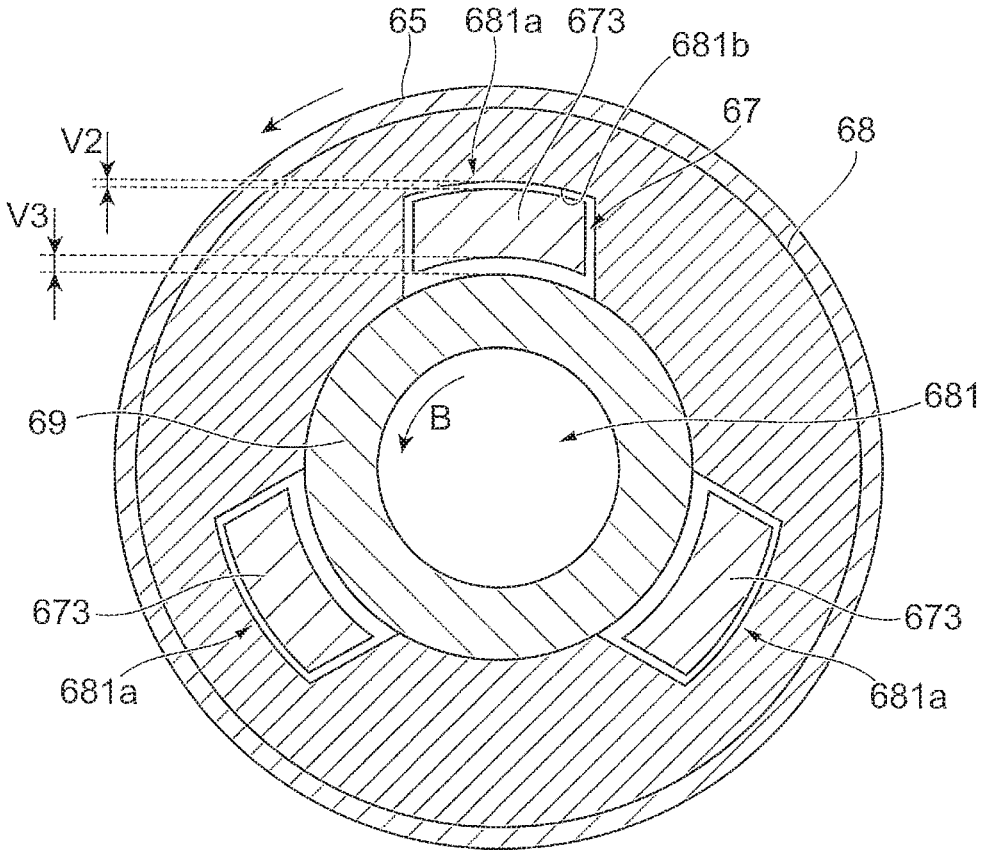
FIG. 5 illustrates a section taken along line V-V illustrated in FIG. 4A.

FIG. 5 illustrates a section taken along line V-V illustrated in FIG. 4A.

As illustrated in FIG. 3, the developing roller 61 includes a cylindrical developing sleeve 65 that is rotatable about an axis of rotation a1.

The developing roller 61 further includes a transmitting member 67 that transmits a driving force to the developing sleeve 65, and a transmitting ring 68 that receives the driving force transmitted from the transmitting member 67 and transmits the driving force to the developing sleeve 65.

The developing roller 61 further includes a magnet shaft 66 as an exemplary inner member. The magnet shaft 66 includes plural magnetic poles.

The developing roller 61 further includes a bearing 69 that serves as a hearing for the magnet shaft 66, and the supporting member 70 that supports the developing sleeve 65. The developing sleeve 65, the transmitting ring 68, and the bearing 69 are exemplary developer carrying members.

The developing sleeve 65 is made of, for example, a metal material such as aluminum.

The transmitting ring 68 has an annular shape and is rotatable. The transmitting ring 68 is made of, for example, a metal material such as aluminum. As illustrated in FIG. 4A, the transmitting ring 68 is provided at the one axial end of the developing roller 61.

As illustrated in FIG. 3, the transmitting ring 68 has a circular through hole 681 extending therethrough in the axial direction of the transmitting ring 68. The transmitting ring 68 further has three recesses 681*a* each extending in the radial direction of the transmitting ring 68 from the inner periphery of the through hole 681 toward the outer side. The three recesses 681*a* are provided next to one another at regular intervals in the direction of rotation of the transmitting ring 68.

The transmitting member 67 has a cylindrical shape and is rotatable. The transmitting member 67 is made of, for example, a resin material such as polyoxymethylene.

As illustrated in FIG. 4A, the transmitting member 67 includes a receiving portion 671 that receives the driving force generated by a driving motor M, and a transmitting portion 672 that transmits the driving force to the transmitting ring 68.

As illustrated in FIG. 3, the transmitting portion 672 has three projections 673 projecting toward one side (a side opposite the side having the receiving portion 671) in the axial direction of the transmitting member 67.

The three projections 673 are provided next to one another at regular intervals in the direction of rotation of the transmitting member 67.

The three projections 673 are fitted in the three respective recesses 681*a* provided in the transmitting ring 68.

The magnet shaft 66 has a bar-like shape and is fixedly provided in the developing sleeve 65.

The magnet shaft 66 includes a base portion 662, plural magnetic poles (not illustrated) provided on the outer periphery of the base portion 662, and a projecting portion 661 projecting from an axial end of the magnet shaft 66 and extending in the axial direction of the magnet shaft 66.

The plural magnetic poles included in the magnet shaft 66 are arranged next to one another in the peripheral direction of the magnet shaft 66. In other words, the positions of the plural magnetic poles in the peripheral direction of the magnet shaft 66 are different from one another.

In the first exemplary embodiment, some of the plural magnetic poles attract the developer, whereby the developer adheres to the surface of the developing sleeve 65. When the developing sleeve 65 rotates, the developer is transported to the position facing the photoconductor drum 11. Then, the developer adheres to the surface of the photoconductor drum 11, whereby a toner image is formed on the surface of the photoconductor drum 11.

As illustrated in FIG. 3, the bearing 69 has a cylindrical shape and is made of, for example, a resin material such as polyoxymethylene.

The bearing 69 includes a circumferential portion 691 extending over the entire circumference of the bearing 69. The circumferential portion 691 extends at a central position in the axial direction of the bearing 69.

As illustrated in FIG. 4A, the bearing 69 includes a closing portion 692. The closing portion 692 closes an opening provided at one axial end of the bearing 69.

As illustrated in FIG. 3, the supporting member 70 has a cylindrical shape and is made of, for example, a resin material such as polyoxymethylene.

In the first exemplary embodiment, the supporting member 70 is fixed to the developing housing 60 (see FIG. 2). As illustrated in FIG. 4A, the supporting member 70 is fitted in the developing sleeve 65 and supports the inner peripheral side of the developing sleeve 65.

As illustrated in FIG. 4B, the supporting member 70 includes a cylindrical body portion 71 and an annular portion 72 annularly provided on the inner side of the body portion 71. The outside diameter of the body portion 71 is smaller than the inside diameter of the developing sleeve 65.

As illustrated in FIG. 4A, the receiving portion 671 of the transmitting member 67 is fitted in the annular portion 72, which serves as a bearing.

As illustrated in FIG. 4B, the supporting member 70 includes an elastic part 73 that is displaceable toward the inner side in the radial direction of the body portion 71.

The elastic part 73 is provided at an opening 71*a* that is provided by cutting the body portion 71. A base end of the elastic part 73 is supported by the body portion 71. The elastic part 73 extends along the periphery of the body portion 71. The elastic part 73 includes a projecting portion 73*a* at the tip of the free end thereof. The projecting portion 73*a* projects toward the outer side the radial direction.

In the first exemplary embodiment, as illustrated in FIG. 4A, the transmitting ring 68 is press-fitted in the developing sleeve 65 and is thus fixed with respect to the developing sleeve 65. The three recesses 681*a* (see FIG. 3) of the transmitting ring 68 are provided around the axis of rotation a1 of the developing sleeve 65.

As illustrated in FIG. 4A, the bearing 69 is press-fitted in the through hole 681 (see FIG. 3) of the transmitting ring 68 and is thus fixed with respect to the transmitting ring 68.

As illustrated in FIG. 4A, the projecting portion 661 of the magnet shaft 66 is fitted in the bearing 69.

In the first exemplary embodiment, a gap is provided in the radial direction of the developing sleeve 65 between the magnet shaft 66 and the inner peripheral surface of the developing sleeve 65.

As illustrated in FIG. 5, the three projections 673 of the transmitting member 67 are fitted in the three recesses 681*a*, respectively, of the transmitting ring 68.

As illustrated in FIG. 4A, the supporting member 70 is placed in the developing sleeve 65. Specifically, the elastic part 73 and a part of the body portion 71 are positioned in the developing sleeve 65.

The receiving portion 671 of the transmitting member 67 is fitted in the annular portion 72 of the supporting member 70.

In the state where the supporting member 70 is placed in the developing sleeve 65, the elastic part 73 is bent toward the inner side in the radial direction as illustrated by broken lines 4A in FIG. 4B. Furthermore, as illustrated in FIG. 4A, the projecting portion 73*a* of the elastic part 73 is pressed against the inner peripheral surface of the developing sleeve 65.

In the radial direction of the developing sleeve 65, a gap V1 is provided between the outer peripheral surface of the body portion 71 and the inner peripheral surface of the developing sleeve 65. Hence, in the first exemplary embodiment, the developing sleeve 65 is displaceable with respect to the supporting member 70. More specifically, the developing sleeve 65 is displaceable in the radial direction of the supporting member 70.

As described above, the receiving portion 671 (see FIG. 4A) of the transmitting member 61 rotates when receiving the rotational driving force from the driving motor M.

When the receiving portion 671 rotates, the transmitting member 67 rotates in the counterclockwise direction as indicated by arrow B in FIG. 5. Hence, the projections 673 of the transmitting member 67 are pressed against the transmitting ring 68, and the rotational driving force is transmitted to the transmitting ring 68. Accordingly, the transmitting ring 68 rotates in the counterclockwise direction in FIG. 5.

When the transmitting ring 68 rotates, the developing sleeve 65 also rotates. Furthermore, the bearing 69 also rotates along with the transmitting ring 68.

In the first exemplary embodiment, as illustrated in FIG. 5, a gap V2 is provided in the radial direction of the transmitting ring 68 between each of the projections 673 of the transmitting member 67 and a wall 681*b* defining a corresponding one of the recesses 681*a* of the transmitting ring 68.

Furthermore, a gap V3 is provided in the radial direction of the transmitting ring 68 between the outer peripheral surface of the bearing 69 and each of the projections 673 of the transmitting member 67.

The presence of the gap V2 and the gap V3 makes the developing sleeve 65 displaceable with respect to the transmitting member 67 (displaceable in the radial direction of the transmitting member 67, see FIG. 4A).

For example, if the developing sleeve 65 is undisplaceable with respect to the transmitting member 67, the eccentricity, if any, of the transmitting member 67 may cause the developing sleeve 65 to rotate eccentrically.

Specifically, depending on factors such as the dimensional accuracy or the dimensional tolerances of the components, the transmitting member 67 may rotate eccentrically. If the developing sleeve 65 is fixed with respect to the transmitting member 67, the developing sleeve 65 also rotates eccentrically.

In such a situation, the distance between the developing sleeve 65 and the photoconductor drum 11 changes with the angle of rotation of the developing sleeve 65, leading co possible nonuniformity in the toner image to be formed on the photoconductor drum 11. Consequently, the quality of the final image to be formed on the sheet P is deteriorated.

In contrast, the developing sleeve 65 is displaceable with respect to the transmitting member 67 as in the first exemplary embodiment, the developing sleeve 65 is less susceptible to the eccentric rotation of the transmitting member 67. Hence, the probability that the developing sleeve 65 may rotate eccentrically is reduced.

In such a configuration, the distance between the developing sleeve 65 and the photoconductor drum 11 is less likely to change. Accordingly, the probability that the final image to be formed on the sheet P may have nonuniformity is reduced.

Furthermore, in the first exemplary embodiment, the developing sleeve 65 is pressed in one direction. Hence, the probability that the developing sleeve 65 may rotate eccentrically is further reduced.

In the first exemplary embodiment, when a developing operation is performed by the developing unit 14, a force pressing the developing sleeve 65 in the radial direction acts on the developing sleeve 65. This force urges and thus positions the developing sleeve 65. In such a configuration the probability that the developing sleeve 65 may rotate eccentrically is further reduced.

More specifically, in the first exemplary embodiment, when toner particles on the developing sleeve 65 reach the position where the trimmer 64 (see FIG. 2) is provided, the toner particles are taken into the gap between the developing sleeve 65 and the trimmer 64. Hence, the toner density increases at the gap. In such a situation, the developing sleeve 65 is positioned by being pushed in the direction of arrow C illustrated in FIG. 2 by the toner particles staying between the developing sleeve 65 and the trimmer 64. Hence, the above-described probability that the developing sleeve 65 may rotate eccentrically is further reduced.

Furthermore, in the first exemplary embodiment, the developing sleeve 65 (the transmitting ring 68) receives the driving force from the transmitting member 67 at three positions. Specifically, the transmitting ring 68 receives the driving force from the transmitting member 67 at the inner walls of the three recesses 681*a* (see FIG. 5).

In such a configuration, the load applied from the transmitting member 67 to the developing sleeve 65 is dispersed among the inner walls of the three recesses 681*a*.

For example, if the developing sleeve 65 receives the load from the transmitting member 67 at one position, the load applied from the transmitting member 67 concentrates on that position. Consequently, the probability that the transmitting member 67 may be deformed or damaged increases.

In contrast, if the developing sleeve 65 receives the driving force from the transmitting member 67 at plural positions as in the first exemplary embodiment, the load applied from the transmitting member 67 is dispersed among those positions, reducing the probability that the transmitting member 67 may be deformed or damaged.

In the first exemplary embodiment, the positions (the three recesses 681*a*) where the developing sleeve 65 receives the load from the transmitting member 67 are defined next to one another at regular intervals in the direction of rotation of the developing sleeve 65.

For example, if the positions where the developing sleeve 65 receives the load are not defined at regular intervals in the direction of rotation of the developing sleeve 65, the probability that the developing sleeve 65 may rotate eccentrically increases. In such a situation, the distance between the developing sleeve 65 and the photoconductor drum 11 changes with the angle of rotation of the developing sleeve 65. Consequently, the toner image to be formed on the photoconductor drum 11 may have nonuniformity.

In contrast, if the positions where the developing sleeve 65 receives the load are defined at regular intervals in the direction of rotation of the developing sleeve 65 as in the first exemplary embodiment, the probability that the developing sleeve 65 may rotate eccentrically is reduced. Consequently, the distance between the developing sleeve 65 and the photoconductor drum 11 is less likely to change. Accordingly, the probability that the image to be formed on the photoconductor drum 11 may have nonuniformity is reduced.

In the first exemplary embodiment, as described above, the magnet shaft 66 is displaceable along with the developing sleeve 65 in the radial direction of the transmitting member 67. More specifically, the magnet shaft 66 is supported by the developing sleeve 65 with the aid of the bearing 69. Therefore, if the developing sleeve 65 is displaced in the radial direction of the transmitting member 67, the magnet shaft 66 is also displaced along with the developing sleeve 65.

Hence, the positional relationship between the magnet shaft 66 and the developing sleeve 65 is less likely to change.

Now, suppose that the magnet shaft 66 is undisplaceable along with the developing sleeve 65. If, for example, the developing sleeve 65 is displaced in the radial direction, the size of the gap between the magnet shaft 66 and the developing sleeve 65 changes. Consequently, the thickness of the developer layer to be formed on the developing sleeve 65 may change.

In contrast, according to the first exemplary embodiment, the magnet shaft 66 is displaceable along with the developing sleeve 65. Therefore, the change in the size of the gap between the magnet shaft 66 and the developing sleeve 65 is reduced. Accordingly, the change in the thickness of the developer layer to be formed on the developing sleeve 65 is reduced.

In the first exemplary embodiment, the supporting member 70 supports the one end of the developing sleeve 65 and also serves as a bearing for the transmitting member 67.

Specifically, in the first exemplary embodiment, the developing sleeve 65 is supported by the elastic part 73 (see FIG. 4A) of the supporting member 70, and the receiving portion 671 of the transmitting member 67 is supported by the annular portion 72 of the supporting member 70.

Hence, the configuration of the developing roller 61 according to the first exemplary embodiment is simplified.

If the developing sleeve 65 and the transmitting member 67 are supported by two different members, respectively, the number of components increases. Hence, the developing roller 61 tends to have a complicated configuration.

In contrast, if the supporting member 70 has two functions of supporting the developing sleeve 65 and supporting the transmitting member 67 as in the first exemplary embodiment, the number of components that form the developing roller 61 is reduced, simplifying the configuration of the developing roller 61.

Furthermore, in the first exemplary embodiment, the supporting member 70 is not press-fitted into the developing sleeve 65, and the gap V1 (see FIG. 4A) is provided in the radial direction of the developing sleeve 65 between the outer peripheral surface of the body portion 71 of the supporting member 70 and the inner peripheral surface of the developing sleeve 65. Hence, the developing sleeve 65 is displaceable in the radial direction of the transmitting member 67.

Furthermore, in the first exemplary embodiment, the elastic part 73 that is displaceable toward the inner side in the radial direction of the body portion 71 is pressed against the inner peripheral surface of the developing sleeve 65, whereby the developing sleeve 65 is supported by the supporting member 70.

That is, in the first exemplary embodiment, one supporting member 70 allows the developing sleeve 65 to be displaced in the radial direction of the transmitting member 67 and supports the developing sleeve 65.

Even in a case where, for example, the supporting member 70 is press-fitted in the developing sleeve 65, the developing sleeve 65 is supported by the supporting member 70. In such a configuration, however, the developing sleeve 65 is difficult to displace with respect to the supporting member 70.

In contrast, if the gap V1 is provided between the body portion 71 and the developing sleeve 65 and the elastic part 73 is pressed against the developing sleeve 65 as in the first exemplary embodiment, the supporting member 70 is allowed to support the developing sleeve 65 and also allows the developing sleeve 65 to be displaced with respect to the supporting member 70.

Furthermore, in the first exemplary embodiment, the supporting member 70 supports the developing sleeve 65 by using the elastic part 73 provided integrally with the body portion 71, and the elastic part 73 that is bendable allows the developing sleeve 65 to be displaced in the radial direction of the transmitting member 67.

Hence, in the first exemplary embodiment, the number of components that form the developing roller 61 is further reduced.

If, for example, the elastic part that allows the developing sleeve 65 to be displaced is provided separately from the supporting member 70, the number of components that form the developing roller 61 increases.

In contrast, if the developing sleeve 65 is supported by using the elastic part 73 provided integrally with the body portion 71 as in the first exemplary embodiment, the developing sleeve 65 is allowed to be displaced in the radial direction of the transmitting member 67 by using a smaller number of components.

Second Exemplary Embodiment

Figure 6:
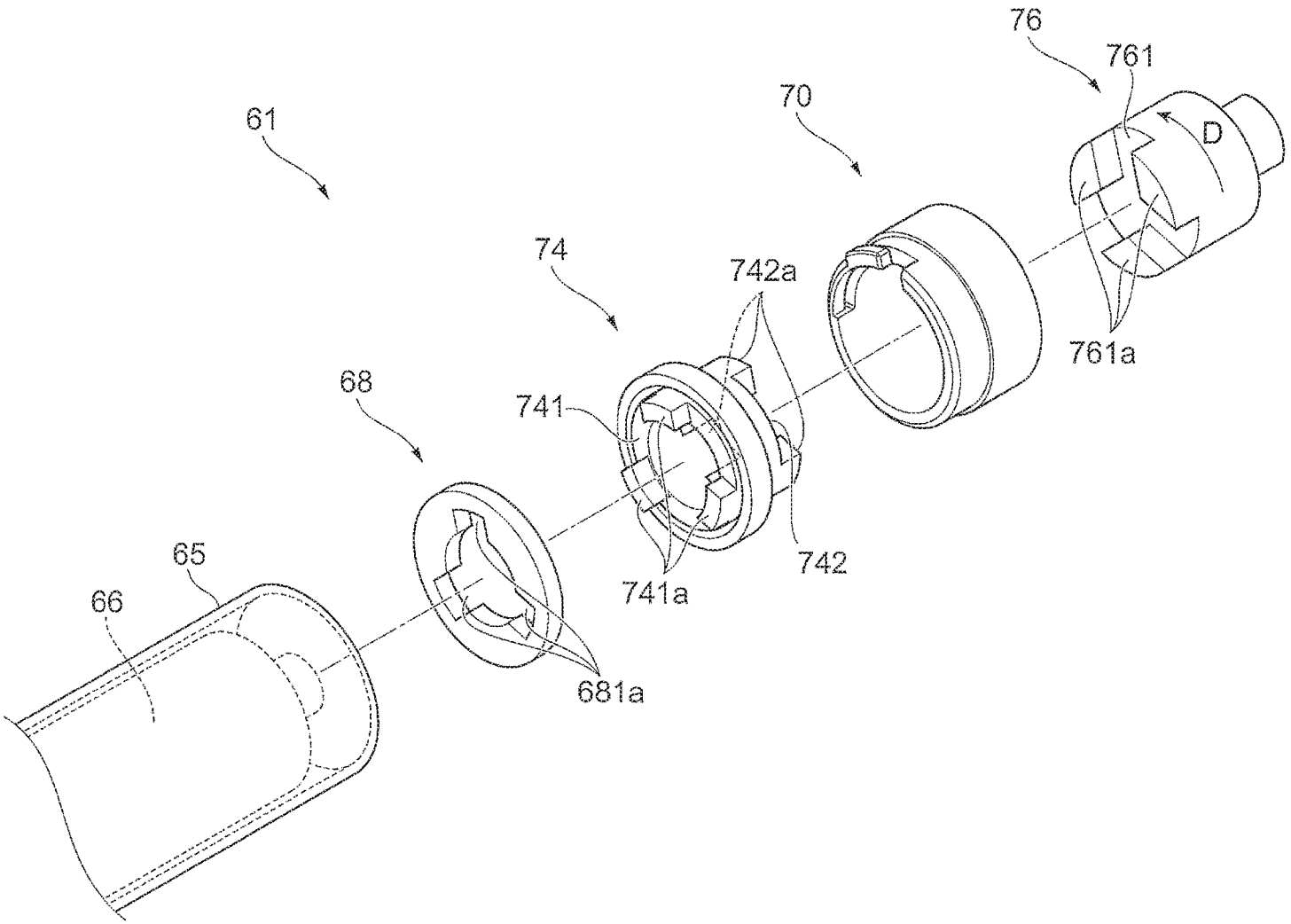
FIG. 6 illustrates a developing roller according to a second exemplary embodiment.

FIG. 6 illustrates a developing roller 61 according to a second exemplary embodiment.

As illustrated in FIG. 6 and as described above, the developing roller 61 includes the developing sleeve 65, the magnet shaft 66, the transmitting ring 68, and the supporting member 70. The developing roller 61 further includes a bearing 74 and a transmitting member 76.

One end surface 741 at one end of the bearing 74 has three first projections 741*a* each projecting toward one side in the axial direction of the bearing 74. An other end surface 742 at the other end of the bearing 74 has three second projections 742*a* each projecting toward the other side (a side opposite the side having the first projections 741*a*) in the axial direction of the bearing 74.

An end surface 761 at one end of the transmitting member 76 has three projections 761*a* each projecting toward one side in the axial direction of the transmitting member 76.

The bearing 74 and the transmitting member 76 are arranged next to each other in the axial direction of the transmitting member 76.

In the second exemplary embodiment, the other end surface 742 of the bearing 74 and the end surface 761 of the transmitting member 76 engage with each other. Specifically, the projections 761*a* of the transmitting member 76 are each fitted in a space between adjacent ones of the second projections 742*a* of the bearing 74, whereby the other end surface 742 of the bearing 74 and the end surface 761 of the transmitting member 76 engage with each other. The other end surface 742 of the bearing 74 and the end surface 761 of the transmitting member 76 are exemplary facing portions that face each other.

Figure 7:
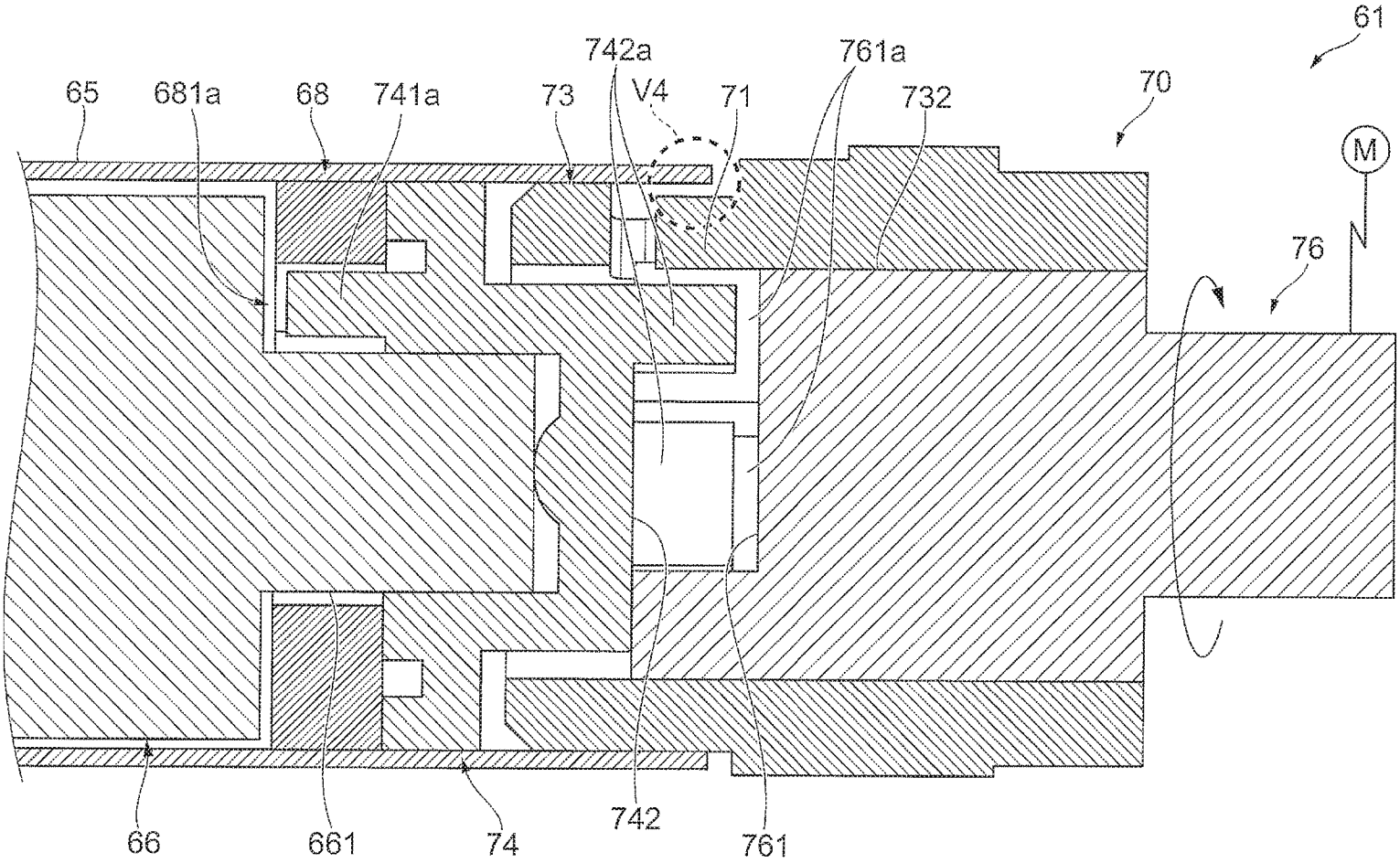
FIG. 7 is a sectional view of one axial end of the developing roller.

FIG. 7 is a sectional view of one axial end of the developing roller 61.

In the second exemplary embodiment, as illustrated in FIG. 7, the three first projections 741*a* are fitted in the three recesses 681*a*, respectively, provided in the transmitting ring 68. Furthermore, the projecting portion 661 of the magnet shaft 66 is fitted in the bearing 74.

In the second exemplary embodiment, as with the configuration illustrated in FIG. 4A, a gap V4 is provided in the radial direction of the developing sleeve 65 between the body portion 71 of the supporting member 70 and the developing sleeve 65. Hence, the developing sleeve 65 is displaceable with respect to the supporting member 70 (displaceable in the radial direction of the supporting member 70).

In the second exemplary embodiment, as illustrated in FIG. 6, when the transmitting member 76 receives the rotational driving force from the driving motor M (see FIG. 7) and thus rotates in the direction of arrow D, the projections 761*a* of the transmitting member 76 are pressed against the second projections 742*a* of the bearing 74, whereby the rotational driving force is transmitted to the bearing 74. Thus, the bearing 74 rotates.

When the bearing 74 rotates, the first projections 741*a* of the bearing 74 transmit the rotational driving force to the transmitting ring 68, whereby the transmitting 68 rotates. When the transmitting ring 68 rotates, the developing sleeve 65 also rotates.

In the second exemplary embodiment also, the developing sleeve 65 is displaceable with respect to the transmitting member 76 and is therefore less susceptible to the eccentricity of the transmitting member 76.

Specifically, in the second exemplary embodiment, a gap is provided between each of the projections 761*a* of the transmitting member 76 and a corresponding one of the second projections 742*a* of the bearing 74. Therefore, the developing sleeve 65 is displaceable with respect to the transmitting member 76 in the radial direction of the transmitting member 76. Consequently, even if the transmitting member 76 is eccentric, the eccentricity is less likely to affect the developing sleeve 65.

Furthermore, in the configuration according to the second exemplary embodiment, the size of the developing roller 61 in the radial direction of the transmitting member 76 is smaller than in the configuration illustrated in FIG. 4A.

For example, in the configuration illustrated in FIG. 4A where the bearing 69 or the like is fitted in the transmitting member 67, the projections 673 of the transmitting member 67 are inevitably positioned on the outer side of the bearing 69 (on the outer side in the radial direction of the bearing 69). Consequently, the transmitting member 67 has a larger radial length L. Correspondingly, the developing roller 61 has a larger radial length.

In contrast, in the second exemplary embodiment (illustrated in FIG. 6) in which the other end surface 742 of the bearing 74 and the end surface 761 of the transmitting member 76 are brought into contact with each other so that the driving force is transmitted from the transmitting member 76 to the developing sleeve 65, the size of the developing roller 61 is reduced.

Third Exemplary Embodiment

Figure 8:
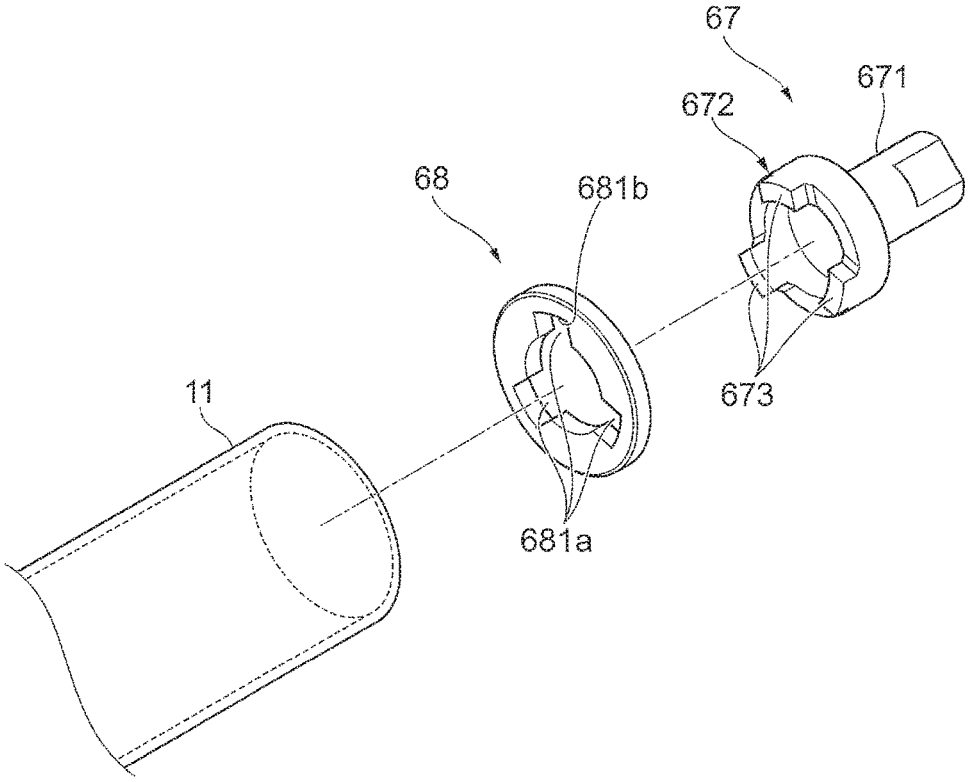
FIG. 8 illustrates a photoconductor drum according to a third exemplary embodiment.

FIG. 8 illustrates a photoconductor drum 11 according to a third exemplary embodiment. Elements that are the same as those described in the first exemplary embodiment are denoted by corresponding ones of the reference numerals.

In each of the first exemplary embodiment and the second exemplary embodiment, the developing sleeve 65 is made less susceptible to the eccentricity of the transmitting member by allowing the developing sleeve 65 to be displaced with respect to the transmitting member. Such a configuration may also be applied to other members such as the photoconductor drum 11 (see FIG. 1), as well as the developing sleeve 65. The photoconductor drum 11 has a function of carrying toner particles as the developer and is therefore regarded as a developer carrying member.

Specifically, in the third exemplary embodiment illustrated in FIG. 8, as with the case of the first exemplary embodiment, the transmitting member 67 is fitted in the transmitting ring 68, with a gap being provided between each of the projections 673 of the transmitting member 67 and the wall 681*b* defining a corresponding one of the recesses 681*a* of the transmitting ring 68.

Hence, the photoconductor drum 11 is displaceable with respect to the transmitting member 67 and is less susceptible to the eccentricity of the transmitting member 67.

Suitable examples of the developer carrying member provided with the transmitting member according to any of the exemplary embodiments of the present invention include the photoconductor drum 11 on which an electrostatic latent image is to be formed, and the developing roller 61 provided at a position facing the photoconductor drum 11 and that develops the electrostatic latent image on the photoconductor drum 11 by attaching the developer to the surface of the photoconductor drum 11. If the distance between the photoconductor drum 11 and the developing roller 61 changes, the density of the final image to be formed on the sheet P is affected by the change. Hence, the change in the distance is desired to be minimized.

The foregoing description of the exemplary embodiments of the present invention has been provided for the purposes of illustration and description. It not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer carrier comprising:

a transmitting member that is rotatable and is configured to transmit a driving force; and a developer carrying member that is configured to carry developer and is provided coaxially with the transmitting member, the developer carrying member being rotatable when receiving the driving force from the transmitting member, the developer carrying member being displaceable with respect to the transmitting member in an intersecting direction that intersects an axial direction of the transmitting member.

2. The developer carrier according to claim 1, wherein a gap that allows the developer carrying member to be displaced with respect to the transmitting member is provided between the developer carrying member and the transmitting member in the intersecting direction.

3. The developer carrier according to claim 1, wherein the developer carrying member is rotatable about an axis of rotation and is configured to receive the driving force from the transmitting member at a plurality of positions defined around the axis of rotation.

4. The developer carrier according to claim 3, wherein the plurality of positions are defined next to one another at regular intervals in a direction of rotation of the developer carrying member.

5. The developer carrier according to claim 1, wherein an inner member is provided on an inner side of the developer carrying member with a gap interposed between the developer carrying member and the inner member, and wherein the inner member is displaceable along with the developer carrying member with respect to the transmitting member in the intersecting direction.

6. The developer carrier according to claim 1, further comprising:

a supporting member that supports one end of the developer carrying member at which the driving force from the transmitting member is received, the supporting member also being configured to function as a bearing for the transmitting member that is rotatable.

7. The developer carrier according to claim 1, further comprising:

a supporting member that supports one end of the developer carrying member at which the driving force from the transmitting member is received, wherein the supporting member supports the one end while allowing the one end to be displaced in the intersecting direction.

8. The developer carrier according to claim 7, wherein the supporting member supports the one end with an elastic part provided integrally with a body portion of the supporting member, and wherein the developer carrier is configured such that the one end is displaced in the intersecting direction when the elastic part is bent.

9. The developer carrier according to claim 1, wherein the developer carrying member and the transmitting member are arranged next to each other in the axial direction of the transmitting member and include respective facing portions that are each provided on a surface at an axial end of a corresponding one of the developer carrying member and the transmitting member, the facing portions of the developer carrying member and the facing portions of the transmitting member facing each other, and wherein the developer carrier is configured such that the driving force is transmitted from the transmitting member to the developer carrying member by bringing the facing portion of the developer carrying member and the facing portion of the transmitting member into contact with each other.

10. A developing device comprising:

a developer carrier; and a developer attaching device that is configured to attach developer to the developer carrier, wherein the developer carrier is the developer carrier according to claim 1.

11. An image forming apparatus comprising:

an image forming device that is configured to form an image on a recording medium by putting developer on the recording medium, the image forming device including:

a developer carrier that is configured to carry the developer; and a developer attaching device that is configured to attach the developer to the developer carrier, wherein the developer carrier is the developer carrier according to claim 1.

12. The developer carrier according to claim 1, wherein the gap is configured such that the developer carrying member is displaceable into the gap.

* * * * *